United States Patent [19]

Ferrara

[11] Patent Number: 4,935,996

[45] Date of Patent: Jun. 26, 1990

[54] COMBINATION HINGE AND CLASP FOR JEWELRY

[76] Inventor: Carl J. Ferrara, P.O. Box 591, No. Attleboro, Mass. 02761

[21] Appl. No.: 342,860

[22] Filed: Apr. 25, 1989

[51] Int. Cl.[5] ..... A44B 13/02

[52] U.S. Cl. ..... 24/598.1; 24/596; 24/33 R

[58] Field of Search ..... 24/573, 574, 598, 590, 24/591, 586, 594, 596

[56] References Cited

U.S. PATENT DOCUMENTS

| | | | |
|---|---|---|---|
| 230,510 | 7/1880 | Untermeyer | 24/574 X |
| 3,408,664 | 11/1968 | Jarman | 24/573 X |
| 3,898,716 | 8/1975 | Aylott | 24/596 |
| 4,398,322 | 8/1983 | Ewen | 24/590 |

FOREIGN PATENT DOCUMENTS

| | | | |
|---|---|---|---|
| 1008818 | 5/1952 | France | 24/590 |
| 678627 | 9/1952 | United Kingdom | 24/591 |
| 2017200 | 10/1979 | United Kingdom | 24/574 |

*Primary Examiner*—Laurie K. Cranmer

*Attorney, Agent, or Firm*—Fleit, Jacobson, Cohn, Price, Holman & Stern

[57] ABSTRACT

A hinge and clasp connection especially adapted for use in jewelry items where it is desirable to separably connect two components and at the same time enable relative pivotal movement between the connected components. The combination hinge and clasp includes interdigitated hinge barrels with a pin engaged with the hinge barrels in one position and disengaged from at least one of the interdigitated hinge barrels when in another position to enable the barrels to be retained in pivotal, aligned condition or separated for separating components of a jewelry item.

4 Claims, 1 Drawing Sheet

COMBINATION HINGE AND CLASP FOR JEWELRY

BACKGROUND OF THE INVENTION

1. Field of the Invention

The present invention generally relates to a hinge and clasp connection especially adapted for use in jewelry items where it is desirable to separably connect two components and at the same time enable relative pivotal movement between the connected components. The combination hinge and clasp includes interdigitated hinge barrels with a pin engaged with the hinge barrels in one position and disengaged from at least one of the interdigitated hinge barrels when in another position to enable the barrels to be retained in pivotal, aligned condition or separated for disconnecting components of a jewelry item.

INFORMATION DISCLOSURE STATEMENT

Various types of hinge connections and clasps have been used in jewelry items. However, the combination of a hinge structure and clasp has not been provided in this art. The following U.S. patents are relevant to this invention but do not disclose the specific structure thereof.

| | |
|---|---|
| 302,421 | 2,843,908 |
| 1,232,238 | 3,042,277 |
| 1,608,807 | 4,000,544 |
| 1,653,535 | 4,578,843 |
| 2,185,736 | |

SUMMARY OF THE INVENTION

An object of the present invention is to provide a combination hinge and clasp for jewelry in which the structure has the appearance characteristics of a hinge but is constructed in a manner to enable the hinge components to be separated thereby enabling two jewelry components to be detachably connected and also hingedly connected by the same structure.

Another object of the invention is to provide a combined hinge and clasp in accordance with the preceding object in which the hinge components include interdigitated hinge barrels with a hinge pin being slidable through the aligned hinge barrels to a closed position to retain them in pivotally connected condition with the pin also being slidable from at least one of the hinge barrels to open position to enable the hinge barrels to be laterally separated thereby forming a clasp for detachably connecting the jewelry components.

A further object of the invention is to provide a combination hinge and clasp as defined in the preceding objects in which the hinge pin is moved into a locking position by compressing a coil spring with the pin then being twisted a partial turn and latched in locked position to prevent the hinge and clasp from accidentally opening due to random motion, impact and the like.

Still another object of the invention is to provide a combination hinge and clasp for jewelry which is highly decorative, relatively simple in construction, unobtrusive, effective in forming a secure hinge and secure clasp and yet a hinge and clasp which can be easily operated to connect components together and maintain them in pivoted relation when the hinge components are connected and easily disconnected when it is desired to remove the items of jewelry.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 2:
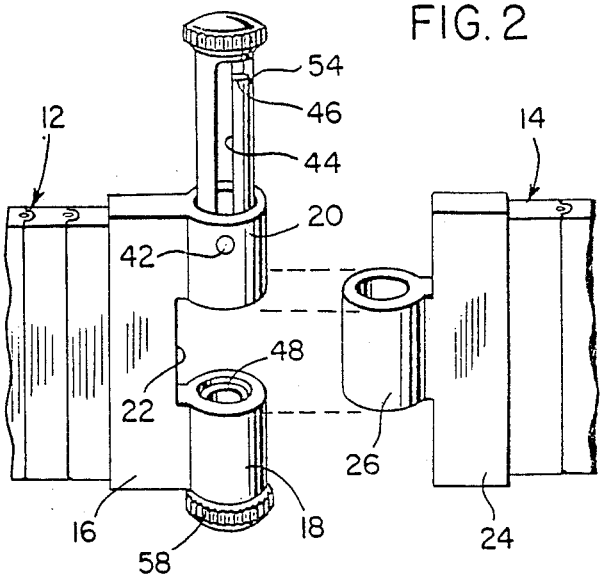
FIG. 2 a perspective view similar to FIG. 1 but illustrating the hinge components in separated condition.

Referring now to the drawings, the combination hinge and clasp for jewelry of the present invention is generally designated by reference numeral 10 and includes jewelry components 12 and 14 with the jewelry component 12 including a plate-like structure 16 having a pair of cylindrical hinge barrels 18 and 20 formed integrally thereon and oriented at one edge thereof with the hinge barrels 18 and 20 having a cylindrical interior and oriented in aligned relation with the space between the hinge barrels being designated by numeral 22 and forming a recess between the hinge barrels 18 and 20 as illustrated in FIG. 2.

The other hinge component 14 includes a plate 24 having a central hinge barrel 26 integrally formed on one edge thereof with the internal and external dimensions of the hinge barrel 26 being substantially the same as the dimensions of the hinge barrels 18 and 20 and the length of the hinge barrel 26 is substantially equal to the length of the recess 22 so that the hinge barrel 26 can be positioned between the hinge barrels 18 and 20 and in alignment therewith so that the hinge barrels 18, 26 and 20 are interdigitated and in aligned relation.

A cylindrical hinge pin 28 is slidably mounted in the hinge barrel 20 and is movable longitudinally through the hinge barrel 26 into the hinge barrel 18 when the hinge barrels 18, 20 and 26 are aligned thereby pivotally interconnecting and securing the hinge barrels so that the jewelry components 12 and 14 can be pivoted in relation to each other about an axis defined by the hinge pin 28.

Figure 1:
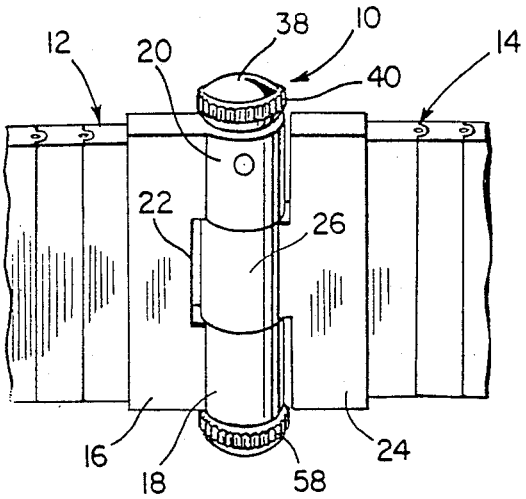
FIG. 1 is perspective view of the combination hinge and clasp for jewelry of the present invention illustrating the components in assembled condition.
Figure 3:
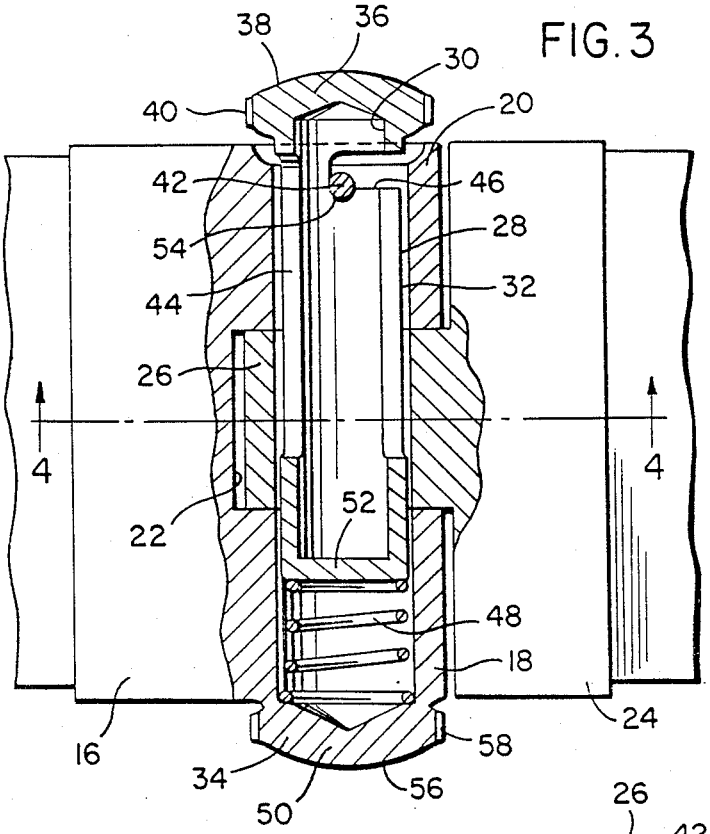
FIG. 3 is a vertical, sectional view, on an enlarged scale, taken along the center line of the combination hinge and clasp of the present invention.
Figure 5:
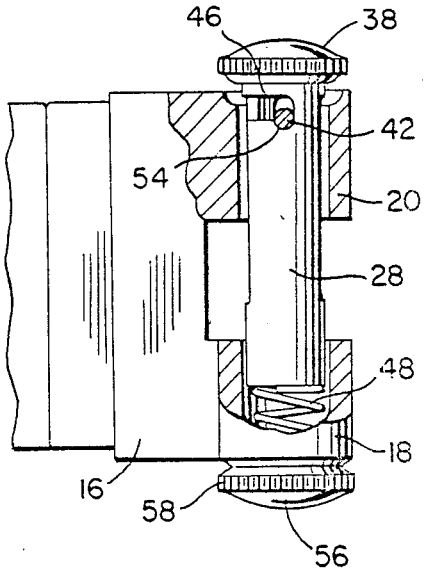
FIG. 5 is an elevational view, with portions broken away, of one of the hinge components with the hinge pin locked in closed position.
Figure 4:
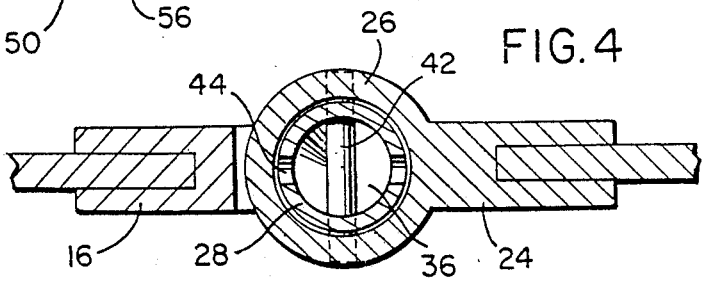
FIG. 4 a transverse, sectional view taken substnatially upon a plane passing along section line 4—4 on FIG. 3 illustrating further structural details of the invention.

As illustrated in FIG. 3, the hinge pin 28 is of tubular construction and provided with a hollow interior 30 and the outer end thereof is provided with a cylindrical head 36 having a convex outer surface 38 and a serrated or knurled peripheral surface 40 which is decorative for appearance purposes. A transverse pin 42 extends across the interior of the hinge barrel 20 and extends through longitudinal slots 44 in diametrically opposed portions of the tubular pin 28. The pin 28 slides on the transverse retaining pin 42 in relation to hinge barrel 20 with the transverse pin 42 retentively mounting the hinge pin in hinge barrel 20. The transverse pin 42 being movably received in the slots 44 enables the hinge pin 28 to be moved longitudinally between an open position as shown in FIG. 2 and a closed and locked position as shown in FIGS. 1, 3 and 5.

The hinge pin 28 can be locked in closed position to prevent accidental opening of the hinge and clasp by random movement, impact and the like. The hinge pin is locked by the use of a pair of laterally extending recesses 46 at the end of the hinge pin 28 having the closed end 36 thereon with the recesses 46 extending circumferentially in opposite directions from the slots 44 thereby enabling the hinge pin 28 to twist or partially turn about its longitudinal axis when the transverse pin 42 is aligned with the recesses 46. A coil spring 48 is positioned in the hinge barrel 18 with one end of the coil spring engaging the closed end 50 of the hinge barrel 18 and the other end of the spring 48 engaging the inner end 52 of the hinge pin 28 as illustrated in FIG. 3 thus biasing the hinge pin 28 in a direction toward the hinge barrel 20. Each recess 46 includes an offset portion 54 remote from the slot 44 with the offset portion being offset toward the closed end 52 of the hinge pin. The offset portions 54 receive the transverse pin 42 when the hinge pin 28 is pushed inwardly to compress the spring 48 and twisted to register the transverse pin 42 with the offset portions so that upon release of the hinge pin 28, the transverse pin 42 will be received in the offset portions 54 thus locking the hinge pin in its closed position to form a hinge connection between the hinge barrels. This forms a bayonet-type lock arrangement to retain the pin 28 in the closed position and requiring that the hinge pin 28 be pressed inwardly against the bias of spring 48 to release the transverse pin from the offset portions 54 so the hinge pin can then be twisted a partial turn to align the transverse pin 42 with the slots 44 so that the hinge pin 28 can then be pulled outwardly to its open position.

To provide symmetry to the hinge connection, the outer end 50 of the hinge barrel 18 is provided with a convex outer surface 56 and a peripheral serrated or knurled surface 58 similar to the structure that closes the outer end of the hinge pin 28. Thus, when the hinge pin 28 is locked in closed position, both ends of the combination hinge and clasp will have a similar appearance which is attractive and which, in effect, conceals the fact that the hinge pin 28 can be moved to open position to separate the jewelry components 12 and 14.

The dimensional characteristics, the shape and external finish characteristics on the components of the combined hinge and clasp may vary depending upon the characteristics of the jewelry that the present invention is utilized with. While the hinge and clasp are disclosed in combination with jewelry items, such as in a watch band, bracelet or the like, the combined hinge and clasp can be used for other purposes in which it is desired to incorporate both a hinge and a releasable clasp in a unitary structure.

The foregoing is considered as illustrative only of the principles of the invention. Further, since numerous modifications and changes will readily occur to those skilled in the art, it is not desired to limit the invention to the exact construction and operation shown and described, and, accordingly, all suitable modifications and equivalents may be resorted to, falling within the scope of the invention.

What is claimed as new is as follows:

1. A combined hinge and clasp comprising a pair of components to be connected together, one of said components including a pair of hinge barrels thereon with the hinge barrels being disposed in axially aligned spaced relation, the other component having a single hinge barrel thereon inserted between the spaced hinge barrels for positioning in alignment therewith, all of said hinge barrels being generally equal in length, a hinge pin slidably mounted in one of said spaced hinge barrels and movable into the interior of said aligned single hinge barrel and the other of said spaced hinge barrels to produce a hinged connection, means mounting the hinge pin in said one of said spaced hinge barrels to selectively retain it in the other hinge barrels to enable separation of the hinge barrels, said hinge pin being a tubular member having diametrically aligned parallel longitudinal slots therein, said slots having closed ends, a coil spring in said other of said spaced hinge barrels with one end of the spring engaging an end of the tubular member when the hinge pin is moved into said other of said spaced hinge barrels, a transverse pin mounted on said one of said spaced hinge barrels and extending through said diametrically aligned longitudinal slots in the hinge pin, the other end of the spring being secured to said other of said spaced hinge barrels to spring bias the hinge pin toward said one of said spaced hinge barrels, one end of each of the diametrically aligned slots including a lateral extension having an undercut terminal edge portion to receive the transverse pin when the hinge pin is moved into closed position with the inner end engaging and compressing the spring and twisted about its longitudinal axis to move the transverse pin into the undercut edge portion of the lateral extensions in the ends of the slots thereby forming a bayonet slot arrangement for releasably locking the hinge pin in all of said hinge barrels to form a releasable hinge connection.

2. The structure as defined in claim 1, wherein the outer end of the hinge pin is provided with a closed convex end having a knurled periphery to facilitate gripping, said other of said spaced hinge barrels receiving the inner end of the hinge pin when forming a hinged connection between the hinge barrels including a closed convex end having a knurled periphery to provide a symmetrical appearance to the hinge and clasp.

3. A combined hinge and connector comprising a pair of members to be hingedly and detachably connected, at least one hinge barrel along an edge of each member for positioning in axial alignment when the members are to be connected, a hinge pin slidably received in said hinge barrels, means retaining the hinge pin in slidably mounted relation in one of said hinge barrels with the hinge pin being selectively and partially received in the other hinge barrel to selectively retain the hinge barrels in aligned, connected and pivotal relation, and means locking said pin against sliding movement when the hinge pin is partially received in the other hinge barrel to prevent accidental disengagement of the hinge barrels and members, said means retaining the hinge pin in slidably mounted relation in one hinge barrel including a transverse retaining pin in said one barrel and a longitudinal slot in the hinge pin receiving said retaining pin whereby the transverse retaining pin can move throughout the length of the slot, said slot having closed ends to prevent disassembly of the hinge pin from said one hinge barrel, said means locking said hinge pin including a laterally extending recess communicating with one end of the longitudinal slot for receiving the retaining pin when the retaining pin is in alignment with the recess and the hinge pin is displaced whereby the retaining pin moves into the recess to prevent longitudinal movement of the hinge pin, and spring means resisting movement of the hinge pin to a position with the recess aligned with the retaining pin, said recess including an offset portion at its inner end for receiving said retaining pin when fully received in the recess whereby said spring means biases the retaining pin into said offset portion of the recess to securely retain the hinge pin in locked position against longitudinal movement until the force exerted by the spring means is overcome and the hinge pin moved longitudinally against the spring means and laterally to move the retaining pin into the longitudinal slot, said members being components of a jewelry item, said hinge pin being cylindrical and the longitudinal slot extending diametrically of the hinge pin, said recess extending circumferentially of the hinge pin in opposite directions at the end of the slot in which the retaining pin is positioned when the hinge pin is postioned to connect said hinge barrels, said spring means being postioned in said other hinge barrel to resist movement of the hinge pin into the other barrel.

4. The structure as defined in claim 3 wherein said slot, retaining pin, recess and offset portion form a twist-type bayonet connection.

* * * * *